US006622780B1

(12) United States Patent
Pötzl

(10) Patent No.: US 6,622,780 B1
(45) Date of Patent: Sep. 23, 2003

(54) METHOD FOR THERMALLY REGENERATING THE HEAT EXCHANGER MATERIAL OF A REGENERATIVE POST-COMBUSTION DEVICE

(75) Inventor: Walter Pötzl, Ammerbuch (DE)

(73) Assignee: Eisenmann Maschinenbau KG (DE)

( * ) Notice: Subject to any disclaimer, the term of this patent is extended or adjusted under 35 U.S.C. 154(b) by 0 days.

(21) Appl. No.: 09/762,760

(22) PCT Filed: May 13, 2000

(86) PCT No.: PCT/EP00/04954

§ 371 (c)(1),
(2), (4) Date: Feb. 9, 2001

(87) PCT Pub. No.: WO00/77453

PCT Pub. Date: Dec. 21, 2000

(30) Foreign Application Priority Data

Jun. 10, 1999 (DE) ..... 199 26 405

(51) Int. Cl.[7] ..... F28D 17/00

(52) U.S. Cl. ..... 165/10; 165/8; 165/5; 165/6; 422/168; 422/173; 432/180

(58) Field of Search ..... 165/4, 8, 10, 5, 165/108; 422/168, 169, 170, 172, 173; 423/210, 210.5, 245.3; 432/180, 181; 431/11, 215

(56) References Cited

U.S. PATENT DOCUMENTS 4,021,194 A * 5/1977 Weislehner ..... 165/5
5,101,741 A * 4/1992 Gross et al.
5,259,757 A * 11/1993 Plejdrup et al.
5,346,393 A * 9/1994 D'Souza
5,538,420 A * 7/1996 Klobucar et al.
5,620,668 A * 4/1997 Driscoll et al.
5,643,539 A * 7/1997 Collard et al.
5,810,581 A * 9/1998 Martin et al.
5,839,894 A * 11/1998 Schedler et al.
6,183,707 B1 * 2/2001 Gosselin et al. ..... 165/5
6,203,316 B1 * 3/2001 Pennington ..... 165/5

FOREIGN PATENT DOCUMENTS

EP 0548630 * 6/1993
EP 0719984 * 7/1996

* cited by examiner

*Primary Examiner*—Christopher Atkinson
(74) *Attorney, Agent, or Firm*—Factor & Partners

(57) ABSTRACT

In order to regenerate the heat exchanger material located in the various segments of a housing section (2) of a regenerative post-combustion device (1), air is heated in the combustion chamber (8) of this post-combustion device (1) by a burner (9), is directly removed from the combustion chamber (8), is adjusted to the desired regeneration air temperature using fresh air, and is returned to the inlet (4) of the thermal post-combustion device (1). The outlet (10) of the thermal post-combustion device (1) remains closed during this operation. The rotary distributor (5) of the thermal post-combustion device (1) rotates during this process which is continued until all segments of the heat exchanger material are heated to a temperature at which the contaminants absorbed by the heat exchanger materials are released and combusted in the combustion chamber (8).

1 Claim, 1 Drawing Sheet

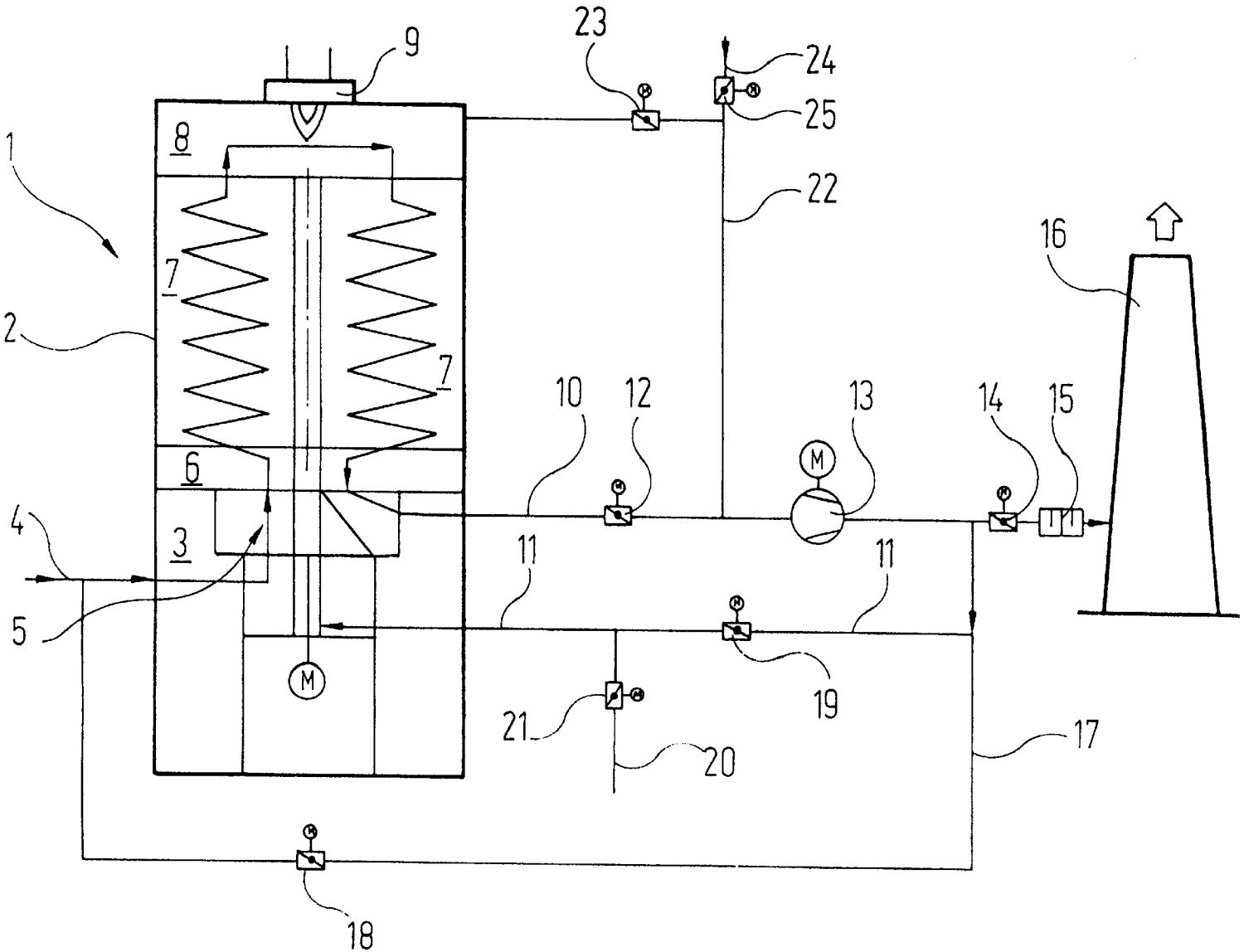
1
2
3
4
5
6
7
8
9
10
11
12
13
14
15
16
17
18
19
20
21
22
23
24
25
M

METHOD FOR THERMALLY REGENERATING THE HEAT EXCHANGER MATERIAL OF A REGENERATIVE POST-COMBUSTION DEVICE

The invention relates to a method for thermally regenerating the heat exchanger material of a regenerative post-combustion device, which in a housing comprises from top to bottom:

a) a combustion chamber;

b) a section, which is divided into several segments filled with heat exchanger material;

c) a rotary distributor having a direction of rotation, which according to its rotary position produces:

ca) a connection between an inlet for a waste gas to be purified and a first segment of the heat exchanger material;

cb) a connection between a second segment of the heat exchanger material and an outlet for the purified gas;

cc) a connection between the third segment of the heat exchanger material, which segment is ahead of the second segment in the direction of rotation of the rotary distributor, and an inlet or an outlet for flushing gas;

in which method air is heated in the combustion chamber, is removed from this, adjusted to the desired regeneration air temperature using fresh air, and is routed successively through all segments of the heat exchanger material, due to which the heat exchanger material is brought to a temperature at which contaminants adsorbed by the heat exchanger material are released.

Regenerative post-combustion devices are used to purify contaminated waste gases from industrial processes. To conserve energy on thermal post-combustion, the waste gases to be purified are led through heat exchanger material. Since the waste gases to be purified often contain organic contaminants in the form of condensable substances, e.g. tar products, or organic dust, the surfaces of these heat exchanger materials become clogged with these contaminants in the course of operation. To regenerate it, the heat exchanger material has to be heated periodically to a temperature at which the contaminants absorbed by the surface are released and can be removed. This takes place in known thermal post-combustion devices in that fresh air is introduced into the combustion chamber, heated there to high temperature and then conducted from the top downwards through the heat exchanger material, routed via the rotary distributor to the outlet and then removed to the outside atmosphere via the chimney. The rotary distributor is stationary in this process. It is waited until the segment of the heat exchanger material flushed through in each case has been heated from top to bottom to the required temperature, so that all areas of the heat exchanger material in this segment are freed of contaminants. The rotary distributor is then rotated by one segment, and the process commences afresh. What is disadvantageous about this known method for regenerating heat exchanger material is on the one hand the relatively long time required to clean all segments. In addition, the gas routed to the chimney contains the contaminants released from the heat exchanger material, and is thus not clean.

The object of the present invention is to configure a method of the type specified at the beginning so that thermal regeneration takes place quickly and in addition no contaminants are released into the ambient atmosphere.

This object is achieved according to the invention in that the air used for thermal regeneration and heated in the combustion chamber is removed from the combustion chamber and returned to the inlet for waste gas to be purified, while the outlet for purified gas is closed, and this air is circulated with the rotary distributor rotating until all the heat exchanger material has been sufficiently heated and all contaminants have been released from this.

Due to the recirculation of the heated air to the inlet provided according to the invention, two things are achieved:

On the one hand, the segment of heat exchanger material acted upon in each case is heated from underneath, i.e. from a side which is normally relatively cool, as it is far removed from the combustion chamber. Uniform heating of the heat exchanger material in the segment can thus be achieved more quickly than if this segment was acted upon with hot air from the combustion chamber. On the other hand, in the process according to the invention, the air which carries the contaminants released from the heat exchanger material is introduced into the combustion chamber, where these contaminants are combusted and thus rendered harmless. Thus only air which is completely free of contaminants is released into the environment via the chimney.

One practical example of the invention is explained in greater detail below with reference to the drawing; the single FIGURE shows diagrammatically a regenerative post-combustion device with the principal peripheral devices required for its operation.

The regenerative post-combustion device is identified in the drawing by the reference symbol 1. Its basic structure and its basic mode of functioning are—unless otherwise stated—described in EP 0 548 630 A1 or EP 0 719 984 A2, to which express reference is made.

In the lower area of the housing 2 of the regenerative post-combustion device 1 is an inlet chamber 3 for the waste gas to be purified, which is supplied via an inlet line 4. Depending on its rotary position, a rotary distributor 5 arranged in the inlet chamber 3 produces a connection between the inlet chamber 3 and a segment from a number of segments in the shape of cake slices in a distribution chamber 6 located above the inlet chamber 3. Located above the distribution chamber 6 in the housing 2 is a heat exchange chamber 7, which is divided into a corresponding number of segments, which each communicate with a corresponding segment of the distribution chamber lying underneath. The segments of the heat exchange chamber 7 are filled with heat exchanger material.

Located above the heat exchange chamber 7 in the top area of the housing 2 is a combustion chamber 8, into which a burner 9 discharges.

The rotary distributor 5 is formed in a known manner such that it connects a further segment of the distribution chamber 6, which is generally diametrically opposed to the first-named segment, and thus also a further segment of the heat exchanger chamber 7 to an outlet line 10 for purified gas. Finally, the rotary distributor 5 produces a connection between that segment of the distribution chamber 6 and thus of the heat exchange chamber 7, which segment is ahead when seen in the direction of rotation of the rotary distributor 5 of the segment which communicates with the outlet line 10, to a flushing air line 11.

The outlet line 10 for purified gas leads via a motor-controlled valve 12 and a fan 13, a further motor-controlled valve 14 and a sound absorber 15 to a chimney 16. Branching off between the fan 13 and the motor-controlled valve 14 is a return line 17, which is connected via a further motor-controlled valve 18 to the inlet line 4 for waste gas to be purified. The flushing air line 11 already mentioned, in which a further motor-controlled valve 19 lies, branches off the return line 17. Also opening into the flushing air line 11 between the valve 19 and the inlet to the regenerative post-combustion device 1 is a fresh air line 20 connected to the outside atmosphere, which line is closable by a further motor-controlled valve 21.

Finally, the combustion chamber 8 is connected to the outlet line 10 for purified gases at a point between the motor-controlled valve 12 and the fan 13; this connection can be opened or closed by a motor-controlled valve 23 opening into the line 22 between the motor-controlled valve 23 and the point of discharge into the outlet line 10 is a fresh air supply line 24, which can likewise be closed by a motor-controlled valve 25.

Normal operation of the regenerative post-combustion device 1, in which contaminated waste gases are treated, corresponds to the known process:

The waste gas 4 to be purified is introduced into the inlet chamber 3 of the regenerative post-combustion device 1 via the inlet line 4 and is conveyed onwards to a certain segment of the distribution chamber 6 according to the respective rotary position of the rotary distributor 5. The waste air rises from this segment of the distribution chamber 6 into the segment of the heat exchange chamber 7 lying above it and takes up heat stored previously from the heat exchanger material there. The waste gas is heated on passing through the heat exchanger material, until on emerging from the top side of the heat exchange chamber 7 it has either reached the ignition temperature for the contaminants contained in it, or is approaching this ignition temperature. In the latter case, combustion of the contaminants is carried out with the aid of the burner 9; in the former case, combustion takes place without the supply of external energy.

The heated air, now containing the (harmless) combustion products, enters a segment of the heat exchange chamber 7 from above and flows downwards through this. In doing so it gives off a large part of its heat to the heat exchanger material there and on the underside of the heat exchange chamber 7, suitably cooled, it enters the corresponding segment of the distribution chamber 6 and is routed by the rotary distributor 5 to the outlet line 10. In this operating mode, the motor-controlled valves 12 and 14 are open and the motor-controlled valves 18, 23 and 25 are closed. The clean air is removed with the aid of the fan 13 via the chimney 16 to the outside atmosphere.

As already mentioned above, the segment of the heat exchange chamber 7 which is ahead in the direction of rotation of the rotary distributor 5 of the segment through which the clean air passes is flushed with flushing air. In the practical example shown, this flushing takes place somewhat differently to the case in the publications mentioned above: here, clean air is supplied, namely via the return line 17 and the flushing air line 11, with the motor-controlled valve 19 open and the motor-controlled valve 21 closed, via the rotary distributor 5 to the appropriate segment of the heat exchange chamber 7. This difference in the nature of the flushing, however, is insignificant for the basic mode of operation of the thermal post-combustion device 1, at any rate in the present connection.

Following a fairly long period of operation, the heat exchanger material located in the heat exchange chamber 7 requires regeneration, as its surfaces have become clogged by substances, for example tar products or organic dust carried by the waste gas to be purified. This thermal regeneration takes place in the regenerative post-combustion device 1 described as follows:

The supply of waste gas to be purified via the inlet line 4 is stopped. The motor-controlled valves 12 and 19 are closed, whereas the motor-controlled valves 14, 18, 21, 23 and 25 are opened.

In this switching state of the various motor-controlled valves, hot air is removed from the combustion chamber 8. Fresh air is admixed via the fresh air supply line 20 and the regeneration air temperature set thereby. The mixed air is taken in using the fan 13 via the line 22 and the open valve 23 and supplied via the return line 17 and the open motor-controlled valve 18 to the inlet line 4 and from there via the inlet chamber 3, the rotary distributor 5 and the corresponding segment of the distribution chamber 6 to a segment of the heat exchange chamber 7. This air enters the combustion chamber 8 upwards again and is heated by the burner 9. The hot air is circulated on the route described, while the rotary distributor 5 continues to rotate. Surplus air in the circuit is removed by suitable opening of the motor-controlled valve 14 to the chimney 16.

The air circulation described is carried out with the rotary distributor 5 running until the heat exchanger material even in the lowest areas has reached the temperature at which the deposits are removed from the heat exchanger material. These contaminants are then brought by the circulating air to the combustion chamber 8 and combusted there. Once this process is complete, the various motor-controlled valves are reset to the starting position once again and the supply of waste air to be purified via the inlet line 4 is resumed.

What is claimed is:

1. A method for thermally regenerating a heat exchanger material of a regenerative post-combustion device, which in a housing comprises from top to bottom:

a) a combustion chamber;

b) a section, which is divided into several segments filled with heat exchanger material;

c) a rotary distributor having a direction of rotation, which according to its rotary position produces:

ca) a connection between an inlet for a waste gas to be purified and at least one corresponding first segment of the heat exchanger material;

cb) a connection between at least one corresponding second segment of the heat exchanger material and an outlet for the purified gas;

cc) a connection between at least one corresponding third segment of the heat exchanger material, which segment is ahead of the corresponding second segment in the direction of rotation of the rotary distributor, and one of an inlet and an outlet for flushing gas, the method comprising the steps of heating air in the combustion chamber, removing the heated air from the combustion chamber, adjusting the removed air to a desired regeneration air temperature using fresh air, conducting the temperature-adjusted removed air successively through all segments of the heat exchanger material, bringing the heat exchanger material to a temperature at which contaminants adsorbed by the heat exchanger material are released, removing the air used for thermal regeneration from the combustion chamber, returning the air to the inlet for the waste gas to be purified, while the outlet for purified gas is closed, and circulating the air with the rotary distributor rotating until all the heat exchanger material has been sufficiently heated and all contaminants have been released from the heat exchanger material.

* * * * *